US009920488B2

(12) United States Patent
Delmonico et al.

(10) Patent No.: US 9,920,488 B2
(45) Date of Patent: Mar. 20, 2018

(54) RAILROAD TIE PLUGGING SYSTEM

(71) Applicants: Douglas Delmonico, Commerce City, CO (US); Stephen R. Epps, Arvada, CO (US); Brandon H. Long, Arvada, CO (US); Jacob Schmidt, Denver, CO (US)

(72) Inventors: Douglas Delmonico, Commerce City, CO (US); Stephen R. Epps, Arvada, CO (US); Brandon H. Long, Arvada, CO (US); Jacob Schmidt, Denver, CO (US)

(73) Assignee: Encore Rail Systems, Inc., Chicago, IL (US)

( * ) Notice: Subject to any disclaimer, the term of this patent is extended or adjusted under 35 U.S.C. 154(b) by 0 days.

(21) Appl. No.: 14/681,686

(22) Filed: Apr. 8, 2015

(65) Prior Publication Data

US 2015/0284912 A1 Oct. 8, 2015

Related U.S. Application Data

(60) Provisional application No. 61/977,015, filed on Apr. 8, 2014.

(51) Int. Cl.

| | |
|---|---|
| ***E01B 31/26*** | (2006.01) |
| ***B05B 13/06*** | (2006.01) |
| ***B05C 1/16*** | (2006.01) |

(52) U.S. Cl.

CPC ..... *E01B 31/26* (2013.01); *B05B 13/06* (2013.01); *B05C 1/16* (2013.01)

(58) Field of Classification Search

CPC ..... E01B 31/26

USPC ..... 118/300, 313–315, 305, 306, 317, 668, 118/669, 679–682, 696, 712, 323; 104/17.1, 2

See application file for complete search history.

(56) References Cited

U.S. PATENT DOCUMENTS

| | | | | |
|---|---|---|---|---|
| 3,745,930 | A | 7/1973 | Dieringer | |
| 4,152,558 | A | 5/1979 | Newman | |
| 5,487,341 | A | 1/1996 | Newman et al. | |
| 5,636,574 | A | 6/1997 | Pierrot | |
| 5,671,679 | A | 9/1997 | Straub et al. | |
| 6,598,537 | B2 | 7/2003 | DeLucia et al. | |
| 6,647,891 | B2 | 11/2003 | Holmes et al. | |
| 6,832,558 | B2 | 12/2004 | Weber et al. | |
| 8,075,302 | B1 | 12/2011 | McClellan | |
| 8,082,850 | B2 | 12/2011 | Plyler et al. | |
| 2013/0102096 | A1* | 4/2013 | Jeromerajan | H01L 21/56 438/25 |

(Continued)

*Primary Examiner* — Yewebdar T Tadesse

(74) *Attorney, Agent, or Firm* — Ice Miller LLP

(57) ABSTRACT

Systems and methods for automated repair and maintenance operations on a railroad track comprise a work head that is automatically moved over the railroad track according to a predetermined pattern, such as the movement of an applicator for tie plugging compound according to a predetermined pattern of spike holes. The automated repair and maintenance operations may be coupled to systems and methods for automatically detecting a feature on a railroad track that comprise two or more distance measurement sensors that travel over the railroad track. Features on the railroad track are detected where the distance measured by each sensor falls within two different predetermined distance ranges.

11 Claims, 9 Drawing Sheets

(56) References Cited

U.S. PATENT DOCUMENTS

2015/0101504 A1* 4/2015 Brenny ..... E01B 31/26
104/2

* cited by examiner

RAILROAD TIE PLUGGING SYSTEM

This application claims the benefit of U.S. Provisional Application No. 61/977,015, filed Apr. 8, 2014, which is hereby incorporated by reference in its entirety.

BACKGROUND OF THE INVENTION

The present invention relates to railroad equipment for "maintenance of way" operations and, in particular, to a system and equipment for automated tie plugging operations and for automated detection of features on a railroad track.

Railroad track generally consists of two parallel rails that are supported on a series of wooden sleepers or cross-ties positioned perpendicular to the rails. The cross-ties are commonly laid on a crushed stone ballast which is packed between and below the cross-ties to hold the track in place. The rails are secured to the tops of the cross-ties by tie plates, which provide a secure housing for the rails and distribute the load over a larger surface of the cross-ties. The tie plates typically comprise a cast or forged steel plate with a substantially flat bottom surface and an upper surface with a pair of parallel ribs that define a cradle area or rail seat for receiving the rail. A plurality of spike holes are formed in the tie plate, on either side of the rail seat. The rails are commonly secured to the tie plates and cross-ties by spikes with offset heads that are driven through the spike holes of the tie-plates and into the wooden cross-ties to clamp the rails to the tie plates.

Over time and with exposure to the elements, cross-ties may become worn or deteriorate to the point where the spikes are only weakly held in the tie and are no longer capable of effectively securing the tie plate and rail to the cross-tie. These worn cross-ties are referred to as "spike killed" ties.

For example, rail traffic exerts repeated lateral and longitudinal forces that can cause the spike holes in the cross-ties to elongate or widen to the point where the rail and tie plate may shift laterally or lift from the cross-tie. The repeated axle loads can also cause "crushed rail seat", where the wood fibers beneath the tie plate break down to the point where the cross-tie can no longer hold the spike. Seasonal wet/dry and freeze/thaw cycles can cause the wooden cross-tie to develop splits, which progress and widen over time until the cross-tie can no longer hold the spikes. Fungal decay can also break down exposed wood fibers to the point where the cross-tie can no longer hold the spike. In addition, cross-ties can become broken, damaged or burned during the course of service, which may contribute to spike kill.

Spike killed cross-ties are commonly repaired by inserting a wooden plug into the spike hole of the damaged cross-tie, or by filling the spike hole with a resin or other polymeric composition. Such chemical tie plugging compounds include foamed epoxies, polyurethanes and polyureas, as are known in the art.

A variety of equipment has been developed for tie plugging operations, including handheld manual and automated applicators for dispensing tie plugging compounds to fill spike holes in cross-ties. The applicators may also be mounted on railroad equipment that travels on one or both of the rails, where the operator either rides on or walks behind the equipment. Self-propelled, ride-on tie plugging equipment is known in the art, which may be configured with multiple applicators and allow multiple operators to work while seated. These ride-on tie pluggers may also be combined with spike pulling equipment for hydraulic extraction of railroad spikes, to allow coordinated railway repair and maintenance operations. An example of ride-on tie plugging equipment that is commercially available is the Encore RGP Ride-On Rail Gang Plugger (Encore Rail Systems, Inc.—Broomfield, Colo.).

Conventional ride-on tie plugging equipment eliminates much of the manual labor of carrying and dispensing the tie plugging compound. However, the operator is still required to locate and accurately position the applicator over each spike hole to be filled in the cross-ties, which can be a time consuming process. In addition, the repetitive nature of the work may lead to operator fatigue and errors. Thus, it would be desirable to provide tie plugging equipment that automates the process of locating and positioning the applicator over the spike holes in the cross-ties.

SUMMARY OF THE INVENTION

An embodiment of an applicator for dispensing a material in the spike holes of a cross-tie in a railroad track is disclosed. The applicator comprises a frame, a first linear actuator mounted on the frame, an applicator nozzle for dispensing the material that is coupled to the first linear actuator to move the applicator nozzle relative to the frame, a microprocessor for controlling the linear actuator, a memory coupled to the microprocessor, and a predetermined pattern of spike holes stored in the memory. The microprocessor directs the first linear actuator to move the applicator nozzle relative to the frame according to the predetermined pattern of spike holes.

In another embodiment, the applicator further comprises first and second distance measurement sensors configured to measure a distance to the railroad track, the first and second distance measurement sensors coupled to the microprocessor, and a predetermined distance stored in the memory. The microprocessor reports a first value for the first or second distance measurement sensor when the measured distance is within a first range defined relative to the predetermined distance, and reports a second value for the first or second distance measurement sensor when the measured distance is within a second range. A first spike hole in the predetermined pattern of spike holes is detected where the microprocessor returns different values for the first and second distance measurement sensors.

In a further embodiment, a system for detecting a feature on a railroad track comprises a frame, first and second distance measurement sensors mounted on the frame for measuring a distance to the railroad track, a microprocessor coupled to the first and second distance measurement sensors, a memory coupled to the microprocessor and a predetermined distance stored in the memory. The microprocessor reports a first value for the first or second distance measurement sensor when the measured distance is within a first range defined relative to the predetermined distance, and reports a second value for the first or second distance measurement sensor when the measured distance is within a second range. A feature is detected where the microprocessor returns different values for the first and second distance measurement sensors.

In yet another embodiment, a method for detecting a feature on a railroad track comprises the steps of providing first and second distance measurement sensors, moving the first and second distance measurement sensors along the railroad track, reporting a first value for the first or the second distance measurement sensor when the measured distance to the railroad track is within a first range relative to a predetermined distance, reporting a second value for the first or the second distance measurement sensor when the measured distance to the railroad track is within a second range different from the first range, and detecting the feature on the railroad track when the first and second distance measurement sensors report different values.

DETAILED DESCRIPTION OF THE INVENTION

Systems and methods for automated repair and maintenance operations on a railroad track are described. A work head is automatically moved over the railroad track according to a predetermined pattern. In one embodiment, the system may be adapted for dispensing a material, such as a railroad tie plugging compound in the spike holes of a cross-tie of a railroad track. The work head includes an applicator nozzle that is automatically moved over a cross-tie and dispenses the railroad tie plugging compound according to a predetermined pattern of spike holes. Systems and methods for automatically detecting a feature on a railroad track are also described, which may be coupled to the automated repair and maintenance operations. In a further embodiment, the detection system is adapted to identify and locate the position of a first spike hole in the predetermined pattern of spike holes. Two or more distance measurement sensors travel over a railroad track and identify the presence of a spike hole at a location where the distance measured by each sensor falls within two different predetermined distance ranges. Those of skill in the art will appreciate that these systems and methods may be adapted to other repair and maintenance operations on a railroad track, such as the automated identification of spike holes in a tie plate and insertion of spikes, or the identification and removal of spikes.

Figure 1:
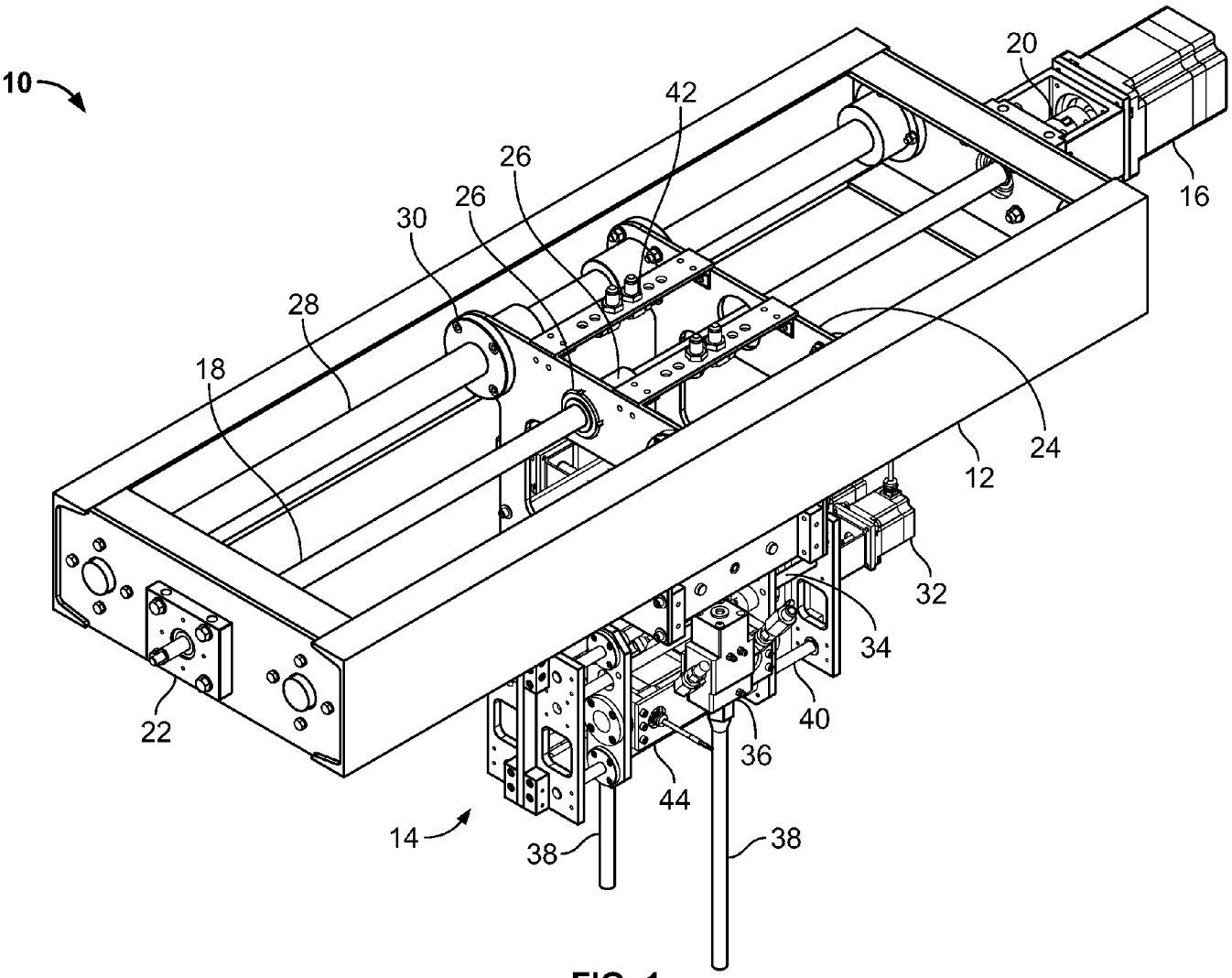
FIG. 1 is an orthographic view of an embodiment of an applicator for automated dispensing of tie plugging compound.
Figure 2B:
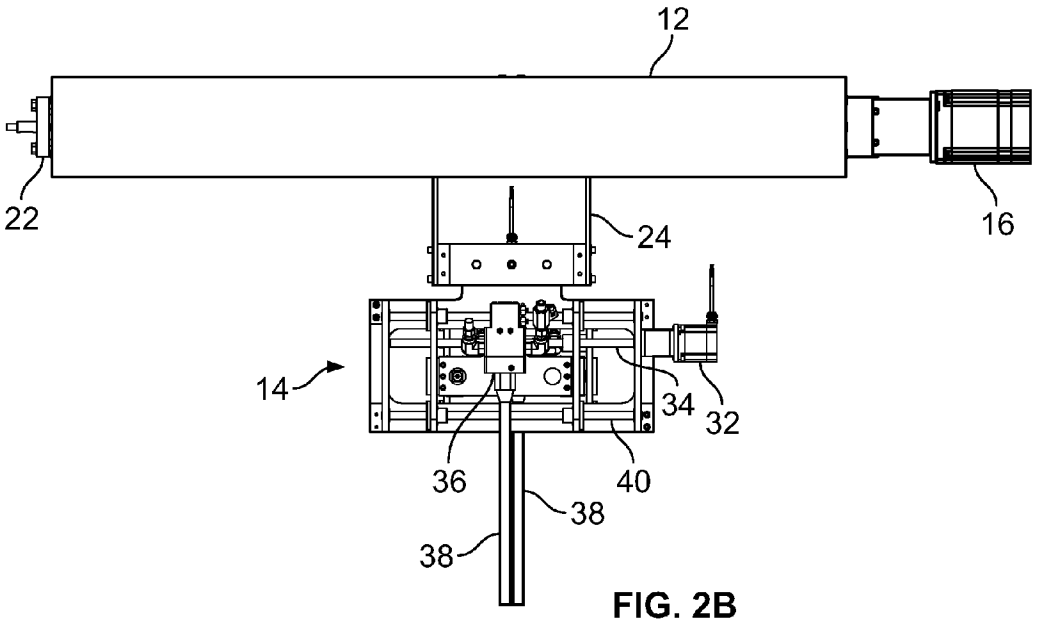
FIG. 2B is a side elevation view of the applicator of FIG. 1.
Figure 2A:
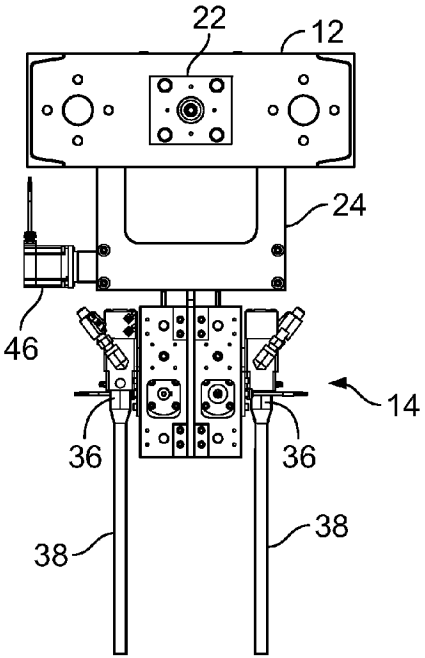
FIG. 2A is an end elevation view of the applicator of FIG. 1.

Referring to FIGS. 1, 2A and 2B, an embodiment of an applicator for automated dispensing of a material such as a tie plugging compound is shown. Applicator 10 comprises a main linear actuator mounted on a support frame 12. The main linear actuator drives the linear movement of one or more applicator nozzles 38 relative to support frame 12.

The main linear actuator comprises a main drive motor 16 coupled to a linear ball screw shaft 18 through a drive coupling 20. Ball screw shaft 18 may be mounted on support frame 12 by support bearings 22. An applicator frame 24 is coupled to ball screw shaft 18 by a nut-ball screw 26. In a preferred embodiment, a linear drive bearing shaft 28 is mounted on support frame 12, parallel to ball screw shaft 18. Applicator frame 24 is also coupled to bearing shaft 28 by linear bearings 30. When main drive motor 16 is actuated, ball screw shaft 18 drives the movement of applicator frame 24, which travels linearly on drive bearing shaft 28.

Applicator nozzles 38 for dispensing a material are coupled to the main linear actuator to move the applicator nozzles relative to support frame 12. For example, where applicator 10 is used to dispense a tie plugging compound in the spike holes of a cross-tie in a railroad track, the main linear actuator moves applicator nozzles 38 in a horizontal plane above the railroad track.

In one embodiment, the applicator nozzles are part of an applicator gun, and are coupled to the main linear actuator through an applicator head. Applicator head 14 is coupled to the main linear actuator to move the applicator head relative to the support frame 12. Applicator head 14 is mounted on applicator frame 24 and comprises a secondary linear actuator that is coupled to an applicator gun. The secondary linear actuator comprises an applicator motor 32 that is coupled to a lead screw 34. The applicator gun is coupled to lead screw 34, and comprises an applicator valve 36 and applicator nozzle 38.

In a preferred embodiment, applicator head 14 further includes a linear applicator bearing shaft 40 parallel to lead screw 34. The applicator gun is coupled to applicator bearing shaft 40. When applicator motor 32 is actuated, lead screw 34 drives the movement of the applicator gun (applicator valve 36 and applicator nozzle 38), which travels linearly on applicator bearing shaft 40. In one embodiment, the secondary linear actuator moves applicator nozzle 38 relative to frames 12 and 24 in a direction parallel to the movement of the main linear actuator, as shown in FIG. 1.

Applicator valve 36 is coupled to a source of the dispensed material, such as a tank for tie plugging compound or other chemical reservoir. In a preferred embodiment, chemical and/or air lines (not shown) are mounted on applicator frame 24 by a support 42, and are coupled to applicator valve 36. Actuating applicator valve 36 dispenses the tie plugging compound from the chemical reservoir through applicator nozzle 38.

In a further preferred embodiment, applicator 10 is configured such that the main and secondary linear actuators move the applicator head 14 in a direction parallel to a railroad track. In a further embodiment, the applicator gun is also configured to move perpendicularly to the railroad track to allow the applicator 10 to adjust to the pattern of spike holes in a tie plate.

Figure 3:
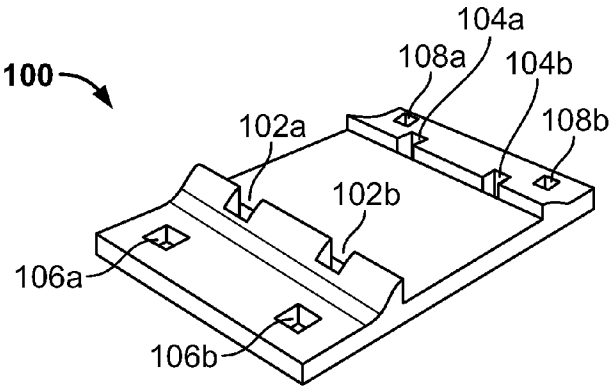
FIG. 3 is a perspective view of a conventional tie plate.

An exemplary railroad tie plate 100 is shown in FIG. 3, which has one or more spike holes positioned adjacent the rail seat for a rail, on the left 102 and the right 104 for receiving offset spikes to fasten the rail (not shown) and tie plate to the cross-tie. In addition, tie plate 100 also has spike holes 106 and 108 positioned further away from the rail seat to fasten the tie plate to the cross-tie. In practice, not all of the spike holes in tie plate 100 may be used. Furthermore, different patterns of spike holes may be used. For example, only spike holes 102*a* and 104*b* may receive spikes. Alternatively, only spike holes 102*a*, 104*b* and 106*b* may receive spikes. To accommodate these different patterns of spike holes, applicator head 14 may be provided with a kick out drive 44 for moving the applicator gun relative to frame 12,—e.g., in a horizontal plane above the railroad track, perpendicularly relative to the railroad track or rail.

In another embodiment, applicator head 14 has two applicator guns that are configured to be positioned on either side of a rail and allow tie plugging compound to be simultaneously dispensed on the right and left sides of the rail. As best shown in FIG. 2A, applicator head 14 has a pair of applicator valves 36 and applicator nozzles 38 in a mirrored configuration. Each applicator gun is coupled to a secondary linear actuator for driving the movement of the applicator guns. In a preferred embodiment, the applicator guns operate independently to allow the applicator 10 to accommodate different patterns of spike holes on the right and left side of the rail.

In yet another embodiment, applicator 10 is also capable of moving the position of applicator head 14 perpendicularly to the rail to adjust to curved railroad track. Applicator 10 may be mounted on railroad equipment for travelling on rails (e.g., a ride-on tie plugger). When the railroad equipment goes over a curved section of the track, the straight frame of the railroad equipment effectively forms a chord relative to the curved track. Thus, the curvature of the track causes the rail and tie plate to be displaced away from the railroad equipment. To adjust for this displacement, a track curvature adjustment drive 46 is mounted on applicator frame 24, for moving the applicator head 14 relative to frame 12—e.g., in a horizontal plane above the railroad track, perpendicularly relative to the railroad track or rail.

Figure 5A:
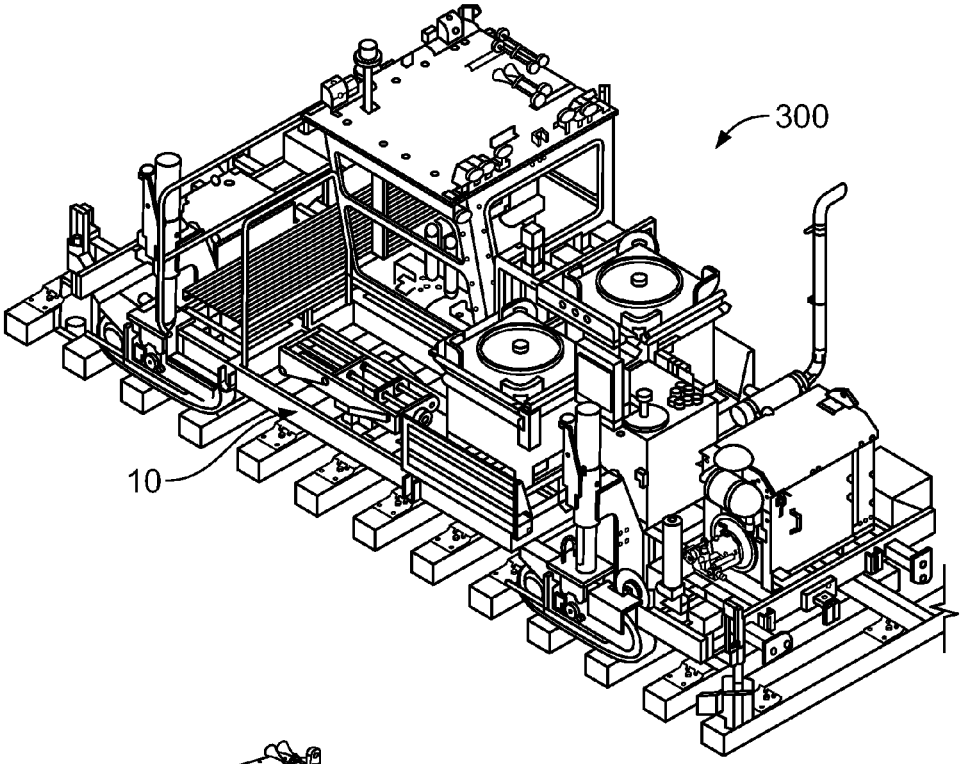
FIG. 5A is an orthographic view of the applicator of FIG. 1, mounted on a ride-on tie plugger.

Applicator 10 may be mounted on railroad equipment, such as a ride-on tie plugger 300, as shown in FIG. 5A. In a preferred embodiment, applicator 10 is configured to be movable vertically relative to the railroad equipment. This allows applicator 10 to be safely raised above the railroad track bed when not in use, to avoid inadvertent damage to the applicator gun or other parts of the applicator during travel. During track repair operations, applicator 10 can be lowered to allow the applicator nozzles 38 to engage the spike holes. Alternatively, applicator 10 may be raised to a maximum height to allow easy access to the applicator head 14—e.g., during maintenance and cleaning of the applicator.

Figure 4A:
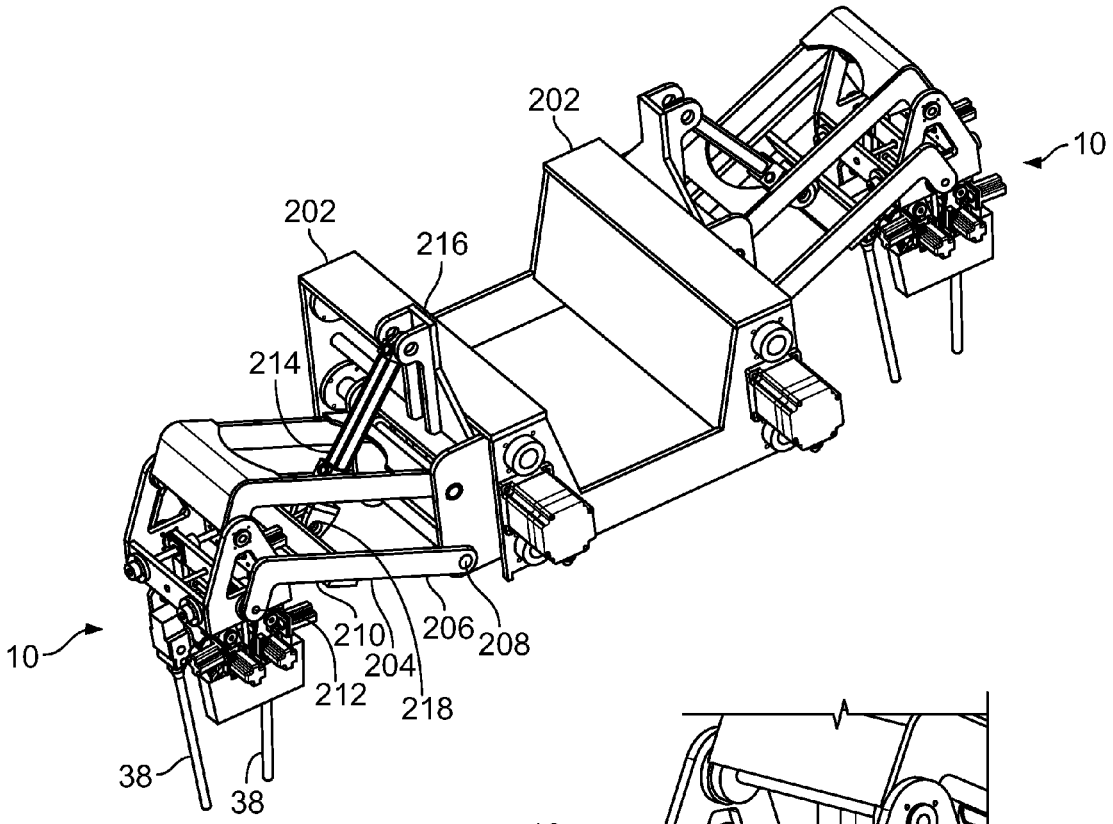
FIG. 4A is an orthographic view of an alternative embodiment of an applicator coupled to a support for mounting on railroad equipment.
Figure 4B:
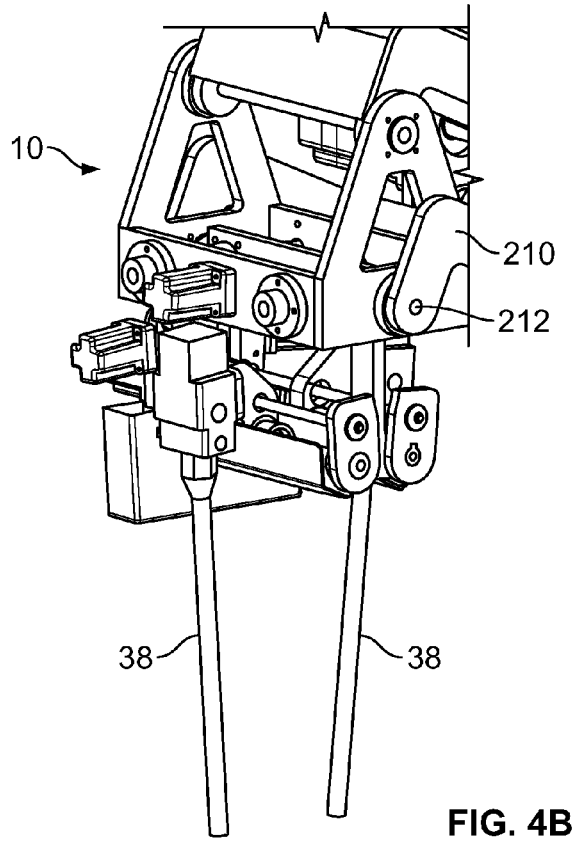
FIG. 4B is a detail view of the applicator of FIG. 4A.
Figure 5B:
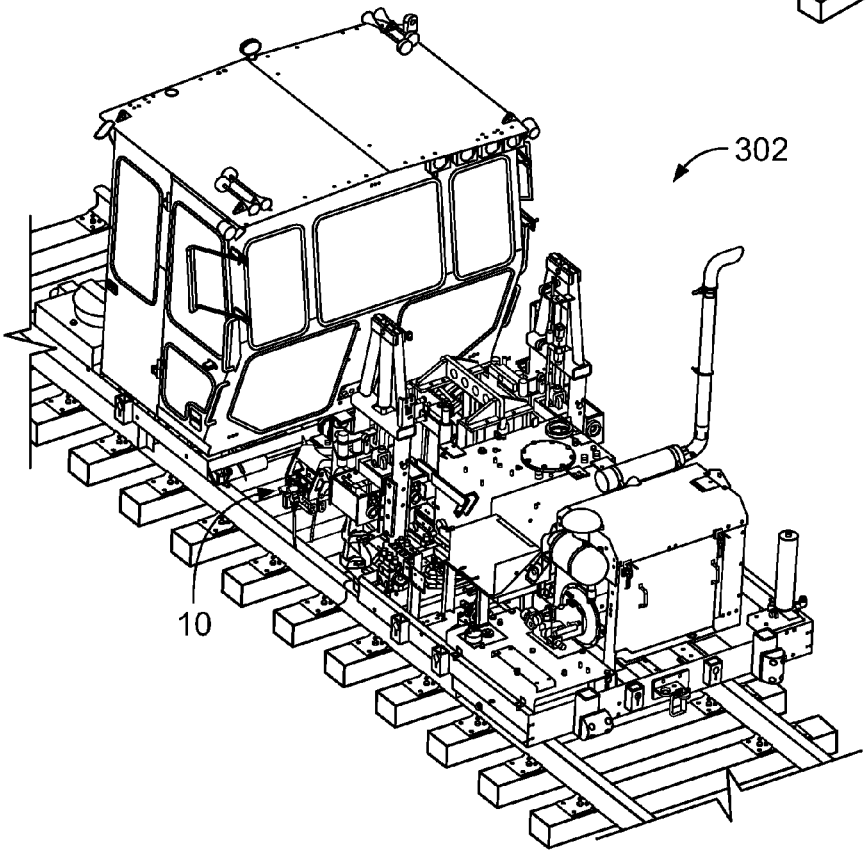
FIG. 5B is an orthographic view of the applicator of FIG. 4A, mounted on a ride-on spike puller/tie plugger.

Referring to FIGS. 4A, 4B and 5B, an embodiment of a system for raising and lowering applicator 10 relative to a railroad equipment is shown. A support 202 is mounted on railroad equipment, such as a ride-on spike puller/tie plugger 302. Applicator 10 is coupled to support 202 by at least one arm 204. As best shown in FIG. 4A, arm 204 has a first end 206 that is pivotally coupled to support 202 by a pin 208, and a second end 210 that is pivotally coupled to applicator 10 by a pin 212. Second end 210 is also coupled to support 202 by a linear actuator such as pneumatic actuator 214. Pneumatic actuator 214 has a first end that is pivotally coupled to support 202 by a pin 216, and a second end that is pivotally coupled to the second end 210 of arm 204 by a pin 218. The extension of pneumatic actuator 214 will lower applicator 10 and the retraction of pneumatic actuator 214 will raise applicator 10.

In a preferred embodiment, a pair of applicators 10 are coupled to the left and right side of support 202 as described above, in a mirrored configuration as shown in FIG. 4A. This configuration allows tie plugging operations to be conducted simultaneously on both rails of a railroad track, and on the right and left sides of each rail. In a particularly preferred embodiment, each applicator 10 is capable of operating independently to accommodate different patterns of spike holes on each rail.

Although the various actuators and drives are referred to as mechanical and pnuematic actuators, the actuators and drives are not limited to the ball screw and lead screw actuators or pneumatic actuators described above. Those of skill in the art will appreciate that other types of actuators may be adapted for use with applicator 10, including, but not limited to, roller screws, screw jacks, rack and pinion, chain drive, belt drives, servo drives, linear motors, cams and hydraulic actuators.

Applicator 10 is preferably controlled by a CAN bus (controller area network) based control system, as is known in the art. The control system comprises a microprocessor, an operator input device such as a joystick, and a display. The microprocessor is coupled to the various actuators and drives described above, and to applicator valve 36 and applicator nozzle 38 to control the operation of applicator 10—e.g., to direct the movement of applicator nozzle 38 relative to frame 12, raise and lower applicator 10, and actuate applicator valve 36 and dispense material from applicator nozzle 38, as described above. An example of a suitable control system is the Parker IQAN system (Parker Hannifin Corp.—Elk Grove Village, Ill.).

Figure 6:
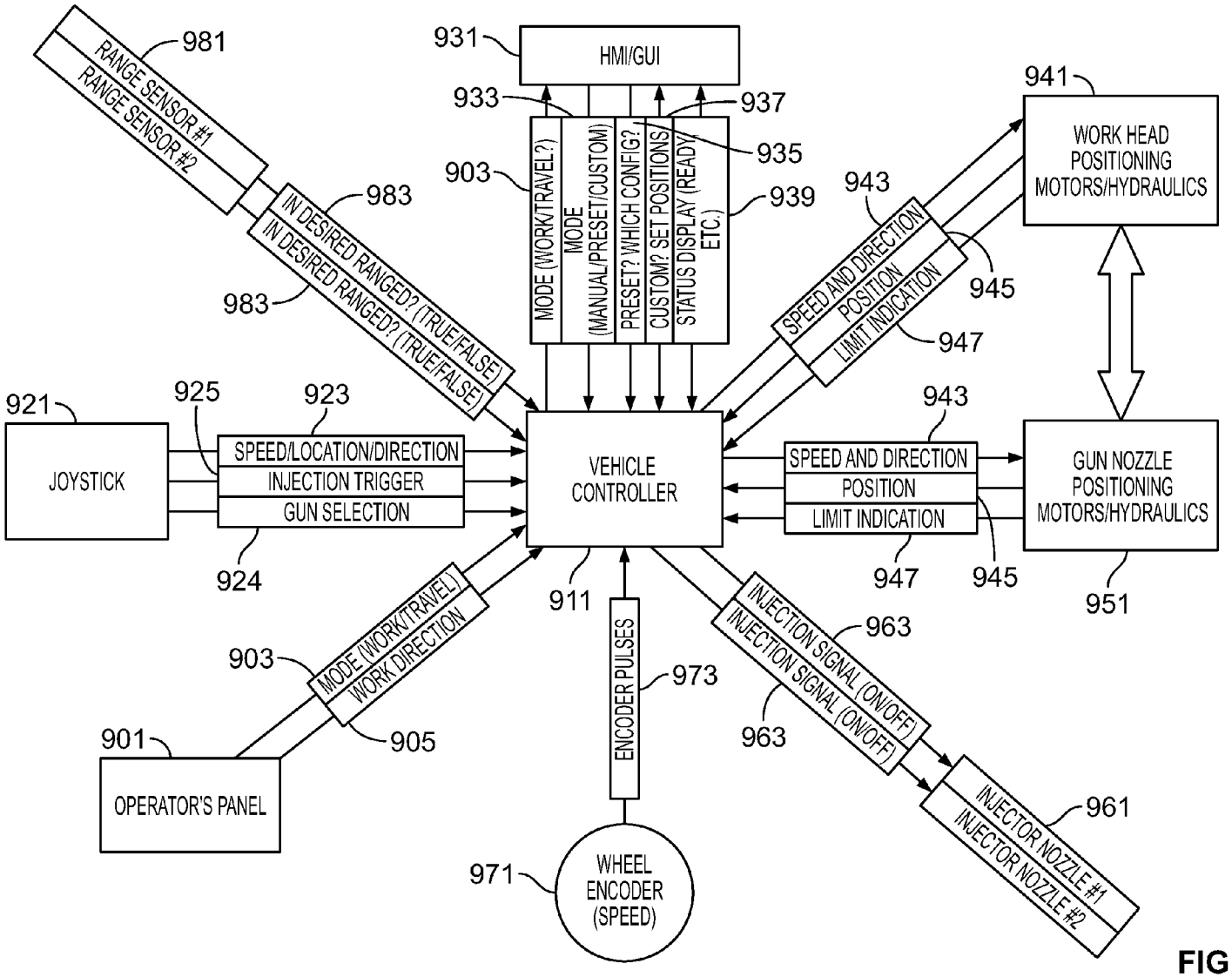
FIG. 6 is a diagram of an embodiment of a control system for an applicator for automated dispensing of tie plugging compound.

The control system takes operator and equipment inputs and uses them in conjunction with internal programming to carry out the task of filling spike holes with the electromechanical applicator head 14. In a preferred embodiment, operator inputs are given through the manipulation of a five-button joystick and through a display using a specifically developed graphical user interface (HMI/GUI). Outputs from the control system are sent via the CAN bus to a network of motor drives that move the applicator guns on the applicator head 14 to the desired positions, as described above. An exemplary control system and its operation are shown in FIGS. 6 and 7.

Figure 7:
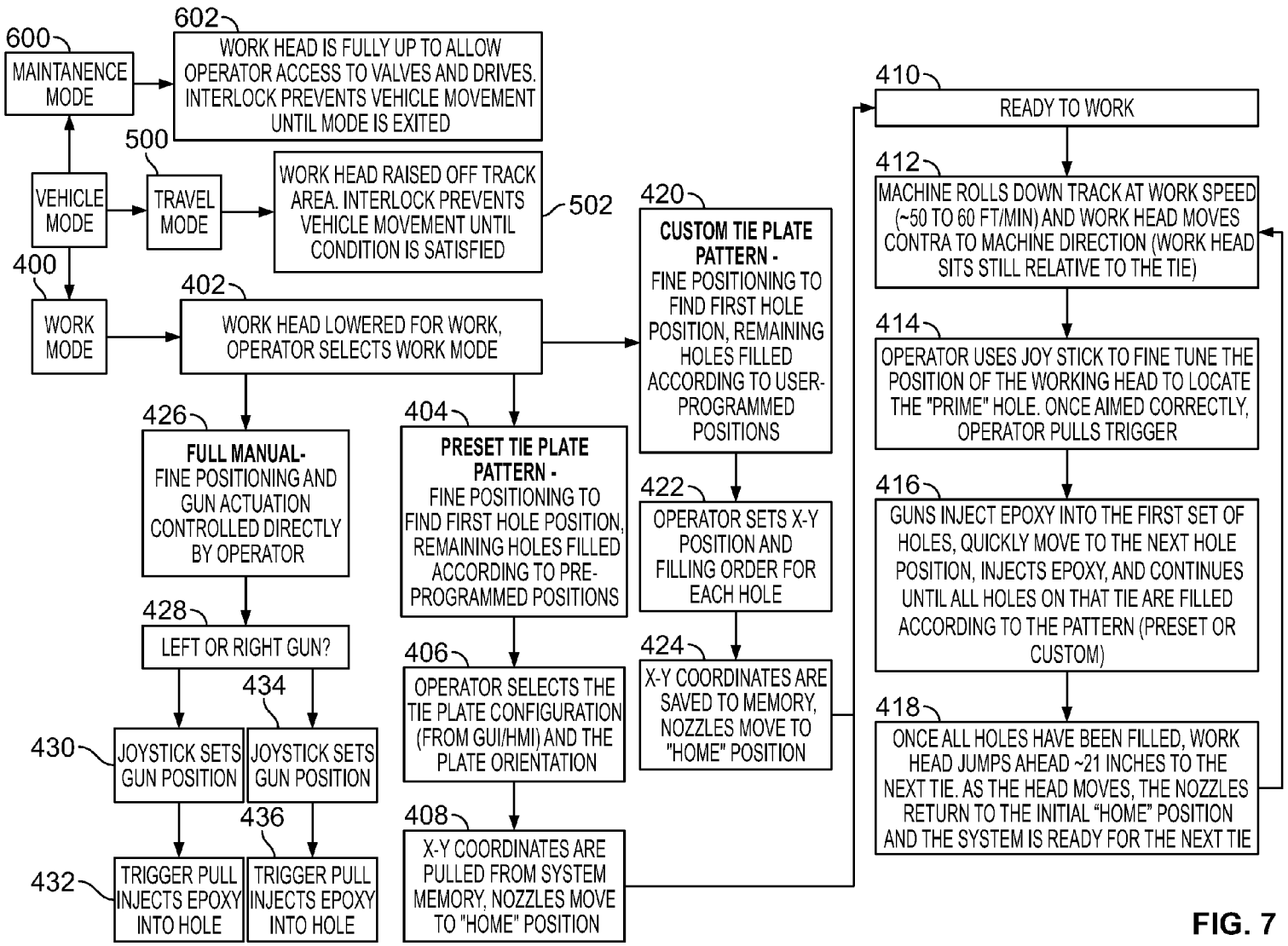
FIG. 7 is a flowchart of an embodiment of the operation of an applicator and control system for automated dispensing of tie plugging compound.

Referring to FIG. 7, an embodiment of the operation of an applicator and control system that comprises alternative modes and processes is shown. In a first step, the operator may input a selection of one of three different modes—Work Mode 400, Travel Mode 500 and Maintenance Mode 600.

In Work Mode 400, applicator 10 is prepared to conduct the operation of filling spike holes in cross-ties. In step 402, the applicator head or work head 14 is lowered to a work height for engaging the spike holes. In a preferred embodiment, the lowered position of the work head 14 provides a signal to the control system to limit the speed of the railroad equipment and allow sufficient time for the work head to dispense the tie plugging compound, as shown in FIG. 6. In a further embodiment, the operator may adjust the time allowed for dispensing the tie plugging compound to compensate for variations in the temperature and curing rate.

While operating in Work Mode, the operator may select from three different work modes—Preset, Custom or Manual work mode.

In step 404, the operator may select a Preset work mode in which the equipment automatically fills the spike holes in the cross-ties based on a predetermined pattern of spike holes. Tie plates are produced in a number of different configurations, where each configuration has its own pattern of spike holes. Thus, if a first or prime spike hole is located and the orientation of the tie plate is known, then the location of all of the remaining spike holes is known based on the predetermined configuration of the tie plate. In one embodiment, a predetermined pattern of spike holes is stored in a memory coupled to the control system or microprocessor. In a preferred embodiment, a library of different tie plate configurations is stored in the memory.

In step 406, the operator inputs a selection of a predetermined pattern of spike holes or preset tie plate spike hole configuration from the library, and may also input the tie plate orientation. In step 408, the control system receives the operator input and retrieves the selected tie plate configuration from the memory, which comprises a preset pattern of spike hole locations stored as x-y coordinates. The control system then zeroes the position of the applicator gun with reference to the x-y coordinate system, by directing the applicator 10 to move the applicator gun to a home or baseline drive position.

In step 410, the applicator gun is in the home position and the equipment is now ready to work. In step 412, the railroad equipment travels at a work speed over the section of the railroad track to be repaired. In a preferred embodiment, the equipment travels at a work speed of about 50 to about 60 feet per minute. While the vehicle moves along the track, the control system calculates the vehicle speed from the received speed encoder 971 input, as shown in FIG. 6. The control system has a countermove function that directs the applicator 10 to move the work head 14 in the opposite direction of travel, such that the work head maintains its position over a cross-tie. This effectively allows the work head 14 to remain stationary relative to the cross-tie as the railroad equipment travels on the railroad track.

In step 414, the control system directs the applicator 10 to position the applicator gun over the first or prime spike hole in the cross-tie—typically, the rearmost, gage-side spike hole in the preset pattern. The operator uses the joystick to fine tune the position of the applicator gun over the prime spike hole. Once the applicator gun is properly positioned, the operator pulls a trigger on the joystick to initiate the automated dispensing of tie plugging compound.

In step 416, the applicator 10 dispenses the tie plugging compound into the prime spike hole. The control system then automatically directs applicator 10 to move the applicator gun over the next spike hole to be filled, based on the preset pattern retrieved from the memory. The control system continues this process until all of the spike holes in the preset pattern have been filled.

In step 418, once all of the spike holes in the preset pattern have been filled, the control system directs the applicator 10 to automatically advance and move the work head 14 forward to the next cross-tie. As work head 14 moves forward, the applicator gun returns to the home position and the process loops back to step 412, until the repair or maintenance operation is completed.

An operator may find it more efficient or otherwise prefer to locate the applicator gun over a prime spike hole without using the automatic advance and countermove function. In an alternative embodiment, steps 412-418 are modified so that the countermove function only operates during injection of tie plugging compound into a spike hole. In step 418, applicator 10 does not automatically advance to the next cross-tie and the applicator gun remains in a fixed position relative to the railroad equipment. The process loops back to step 412, where the countermove function is not used and the applicator gun simply moves toward the next cross-tie as the railroad equipment travels at a work speed over the railroad track. In step 414, the operator uses the joystick to adjust the position and align the applicator gun with the prime spike hole as the applicator approaches the next cross-tie. Once the applicator gun is properly located over the prime spike hole, the operator pulls a trigger on the joystick to initiate the automated dispensing of tie plugging compound. In step 416, pulling the trigger initiates the countermove function to keep the applicator gun in position over the prime spike hole during injection of the tie plugging compound, while the railroad equipment continues to travel over the railroad track.

In another alternative embodiment, the Work Mode includes a Custom work mode. In step 420, the operator may select a Custom work mode in which the equipment automatically fills the spike holes based on a pattern entered by the operator. In step 422, the operator inputs the locations of a pattern of spike holes to be filled and the order in which the spike holes are to be filled. In step 424, the control system saves the input coordinates to memory and directs the applicator 10 to move the applicator gun to its home position. The process then proceeds to step 410 and continues as described above.

In a preferred embodiment, the Custom work mode comprises a Teach mode in which the operator manually positions the work head 14 and applicator gun(s) at a desired position—e.g., where the applicator nozzle 38 is positioned above a spike hole. The operator then inputs a command to the control system to record that position—e.g., by pushing a button on the joystick or provided on the display. The control system stores the position of the applicator gun(s) in memory. In a preferred embodiment, the position of the applicator gun(s) is stored as x-y coordinates. The operator repeats this process for each of the spike holes in the desired pattern. Once the positions of all of the spike holes in the pattern have been stored and the pattern is set, the applicator 10 moves to its home position, and the Custom work mode operates in the same way as the Preset mode, proceeding to step 410.

In a further alternative embodiment, the Work Mode includes a Manual work mode. In step 426, the operator may select a Manual work mode, in which the operator has full control over the actuator 10 and can position each applicator gun independently and dispense the tie plugging compound for each spike hole in the cross-tie. During Manual work mode, each applicator nozzle 38 has a full range of motion available and can be aimed through joystick control. Each applicator valve 36 can be fired independently or together, depending on the situation. This mode will typically be used while the vehicle is stationary and for intermittent hole filling. However, in a preferred embodiment, the operator also has the option of using the countermove function or not.

In step 428, the operator inputs a selection of the particular applicator gun to be controlled. For example, where the work head 14 has left and right applicator guns positioned on either side of a rail, the operator may select either applicator gun. The operator then uses the joystick to position the left 430 (or right 434) applicator gun over the desired spike hole in the cross-tie. Once the applicator gun is properly positioned, the operator pulls the trigger on the joystick in step 432 (or 436) to dispense tie plugging compound into the spike hole.

In addition to the Work Mode, the operator may also select either a Travel Mode or a Maintenance Mode. In step 500, the operator selects the Travel Mode. In step 502, the applicator 10 is raised to an intermediate height above the railroad track that provides adequate clearance for the railroad equipment to travel along the railway at any required speed without danger of inadvertent damage to work head 14. In a preferred embodiment, the equipment is provided with an interlock that prevents the equipment from moving faster than a predetermined speed unless the work head is in Travel Mode.

In step 600, the operator selects the Maintenance Mode. In step 602, the applicator 10 is moved to a fully raised position to allow convenient access to the valves and drives to carry out required repairs and regular maintenance. In a preferred embodiment, the equipment is provided with an interlock that prevents the equipment from moving while the work head is in Maintenance Mode for the operator's safety.

In one embodiment, the electronic control system may also incorporate audio/visual information and/or instruction guides to assist the operator. In a preferred embodiment, the system provides audio status updates and audio instructions based on the status of the equipment and/or the actions of the operator. The control system may also display video, still and/or 3D representations of safety information, troubleshooting and repair procedures and/or maintenance instructions. In another embodiment, the control system is configurable and expandable to provide specific required information for different customers, regions and languages.

An exemplary control system is shown in FIG. 6, comprising a controller 911 that includes a microprocessor. When the applicator is mounted on railroad equipment, control of the vehicle may be provided by an operator's panel 901 that allows the operator to select the direction 905 and mode of operation 903 of the vehicle and inputs the selection to controller 911. In one embodiment, operator's panel 901 comprises one or more physical switches that permit the operator to select the direction of travel of the railroad equipment, and to select between Work Mode, Travel Mode and Maintenance Mode as described in steps 400, 500 and 600.

Controller 911 is coupled to an output device for displaying the status of the railroad equipment, including the direction and mode of operation selected in operator's panel 901. In one embodiment, the output device is a graphical user interface or other human machine interface system (HMI/GUI) 931 that displays the status and allows the operator to further control the railroad equipment and applicator.

In a preferred embodiment, HMI/GUI 931 is a touch-screen display. Once a specific (work, travel or maintenance) mode 903 is selected, controller 911 directs HMI/GUI 931 to display the selected mode. If work mode is selected, HMI/GUI 931 allows the operator to further input a selection 933 of Preset, Custom or Manual work modes as described in steps 404, 420 and 426. If Preset Mode is selected, HMI/GUI 931 allows the operator to further input a selection 935 of a predetermined pattern of spike holes from the library of different tie plate configurations as described in step 406. If Custom Mode is selected, HMI/GUI 931 allows the operator to further input 937 the locations and order of the spike holes to be filled as described in step 422. Controller 911 may also direct HMI/GUI 931 to provide a status display 939 that provides the operator with confirmation that the mode of operation of the applicator has been properly selected, and that the railroad equipment and applicator are ready to proceed.

An operator input device such as a joystick 921 with a trigger and one or more buttons is also coupled to controller 911, to allow the operator to manually control the position of the applicator head 923, select between multiple applicator guns 927, and/or trigger the injection or dispensing of tie plugging compound 925.

In a further embodiment, controller 911 is also coupled to a speed sensor such as a wheel encoder 971, as are known in the art. The speed sensor inputs information regarding the speed of the railroad equipment 973 to controller 911, which may be used control a number of functions of the applicator, including the speed of the countermove function and/or to determine whether the speed of the railroad equipment is beyond the limit of travel of the applicator head.

Controller 911 uses the inputs from the operator's panel 901, HMI/GUI 931 and joystick 921 to direct the operation of the various applicator drives and movement 943 of applicator head 941 and applicator gun 951, and to direct dispensing of tie plugging compound. The applicator head positioning motors/hydraulics 941 and the gun nozzle positioning motors/hydraulics 951 report back a real time position 945 of their location to the controller 911, including a limit indication 947 to signal that the applicator head and/or applicator gun have reached their end of travel. Operating the trigger of joystick 921 directs controller 911 to signal the injection 963 of tie plugging compound through the applicator nozzles 961. In a preferred embodiment, the injection time may also be controlled to adjust for the size of the hole or the viscosity of the material (e.g. in cold temperatures).

In yet another embodiment, controller 911 may also be coupled to a feature detection system that would allow the applicator to automatically identify and locate a spike hole or other feature of the railroad track without manual input from an operator. As shown in FIG. 6, controller 911 is coupled to a featured detection system comprising two or more distance measuring sensors 981 that input information regarding the distance to features on the railroad track 983, as described in detail below.

In the embodiments described above, the operator must manually locate and position the applicator gun over at least a first or prime spike hole in a cross-tie, before the control system can initiate the automated positioning of the applicator gun over the remaining spike holes in the cross-tie. Such manual operations can be labor intensive, time consuming and costly. Thus, it would be desirable to provide an automated system for accurately detecting the location of spike holes in cross-ties, or other feature of the railroad track without operator assistance. The feature detection system would preferably be able to identify and distinguish the cross-ties from the surrounding ballast, and to differentiate between the feature of interest and other structures of the railroad track—e.g., between spike holes and cracks in the cross-ties. It would also be useful that the system is not affected by extreme weather, temperature or other environmental conditions.

Figure 8:
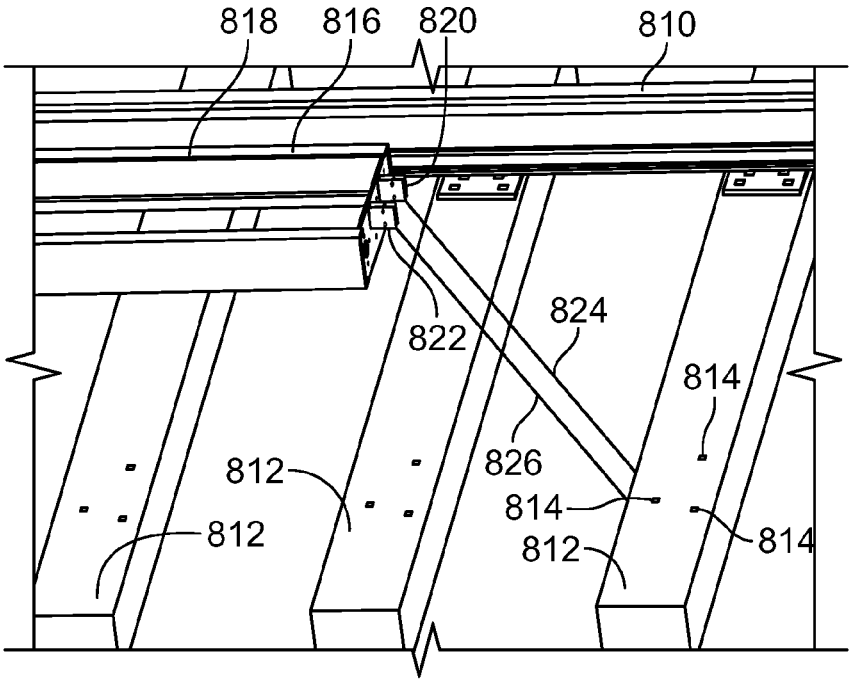
FIG. 8 is an orthogonal view of a spike hole detection system using laser distance location, that is positioned over a section of railroad track.

Referring to FIGS. 8-13, an embodiment of a feature detection system is shown that uses a distance measurement sensor for detecting spike holes in cross-ties. In FIG. 8, a spike hole detection system is shown positioned over a section of railroad track including a rail 810 and cross-ties 812. During repair operations, one rail may be removed from the track, leaving spike holes 814 in the cross-ties 812. The spike hole detection system comprises a work head 816 coupled to a reference frame 818. Work head 816 comprises one or more distance measurement sensors that measure the distance of an object relative to the reference frame 818.

Protection from the harsh environment that may be experienced on a railway may be provided by shielding and/or a casing (not shown) that covers the distance measurement sensors, and that preferably has a protection rating of at least IP65 under IEC standards. The spike hole detection system may also contain shielding and/or guards (not shown) to protect the distance measurement sensors from debris, impact, and weather depending on the embodiment.

In a preferred embodiment, the distance measurement sensors are laser distance measurement sensors. As shown in FIG. 8, work head 816 comprises two laser distance measuring sensors 820 and 822 with laser beams 824 and 826, respectively. Although two laser distance measuring sensors are shown, the system may contain more sensors depending on the application and type of feature being detected. An example of a laser distance measurement sensor that is commercially available is the Keyence LR-TB2000 (Keyence Corporation of America—Itasca, Ill.). Those of skill in the art will appreciate that other types of distance measurement sensors may be adapted for use in a feature detection system—e.g. sonic sensors or optical sensors.

In one embodiment, the laser distance measuring sensors 820 and 822 are coupled to a microprocessor, such as the microprocessor of the control system described above. A predetermined distance is stored in the memory, such as the distance to the top surface (height) of a cross-tie 812. The microprocessor reports a first value (e.g., "false") for laser distance measuring sensors 820 or 822 when the measured distance is within a first range—e.g., where the measured distance is greater than the predetermined distance. For example, when the laser beams 824 and 826 are positioned over the ballast or other feature of the railroad track that is below the height of cross-ties 812, the microprocessor reports a value of "false" for each laser distance measuring sensor 820 and 822. The microprocessor reports a second value (e.g., "true") for laser distance measuring sensors 820 or 822 when the measured distance is within a second range—e.g., where the measured distance is less than or equal to the predetermined distance. For example, when the laser beams 824 and 826 are positioned over a cross-tie 812, the microprocessor reports a value of "true" for each laser distance measuring sensor 820 and 822.

The predetermined distance may be a preset distance stored in the memory. For example, the predetermined distance may be a preset distance measured from the reference frame of 33 inches. In an alternative embodiment, the predetermined distance may be input manually by the operator. For example, the operator may position laser beams 824 and/or 826 over a cross-tie 812 and the measured height of the cross-tie input as the predetermined distance.

In a preferred embodiment, the predetermined distance is a range of distances—e.g., the height of a cross-tie+/−0.5 inches. The predetermined distance range allows the detection system to be adjusted to account for variations in the height of the cross-ties in the railroad track, and to allow the system to ignore any minor irregularities in the surface of the cross-tie, such as depressions, cracks and bumps. In one embodiment, the predetermined distance range is stored in the memory by inputting the height of a cross-tie 812 and applying a preset or manually entered range to the input height.

In the embodiments described above, the first and second measured distance ranges are defined relative to the predetermined distance—i.e. as greater than, and less than or equal to the predetermined distance. Where the predetermined distance is a distance range, the measured distance ranges may be defined relative to the predetermined distance range. For example, the microprocessor may report a value of "true" for laser distance measuring sensors 820 or 822 when the measured distance is within the predetermined distance range and "false" when the measured distance is outside the predetermined distance range. Preferably, the defined ranges are not overlapping.

In yet another embodiment, the microprocessor may be programmed with a delay before reporting a value of "true" for one or both laser distance measuring sensors. The delay reduces the chance that an irregular feature of the railroad track may cause a false "true" reading, and increases the likelihood that a "true" value is only reported when the laser beams 824 and/or 826 are positioned over a cross-tie 812. For example, as the laser beams 824 and 826 travel over a railroad track, they may encounter ballast rock or other features between cross-ties 812 that are high enough to cause a momentary reading of "true". A delay ensures that these transient "true" readings do not cause the microprocessor to report "true" for laser distance measuring sensors 820 and 822. The delay may be predetermined and set within the detection system or may be manually entered. In a preferred embodiment, the delay is a predetermined time period in the range of 50-200 milliseconds.

Figure 9:
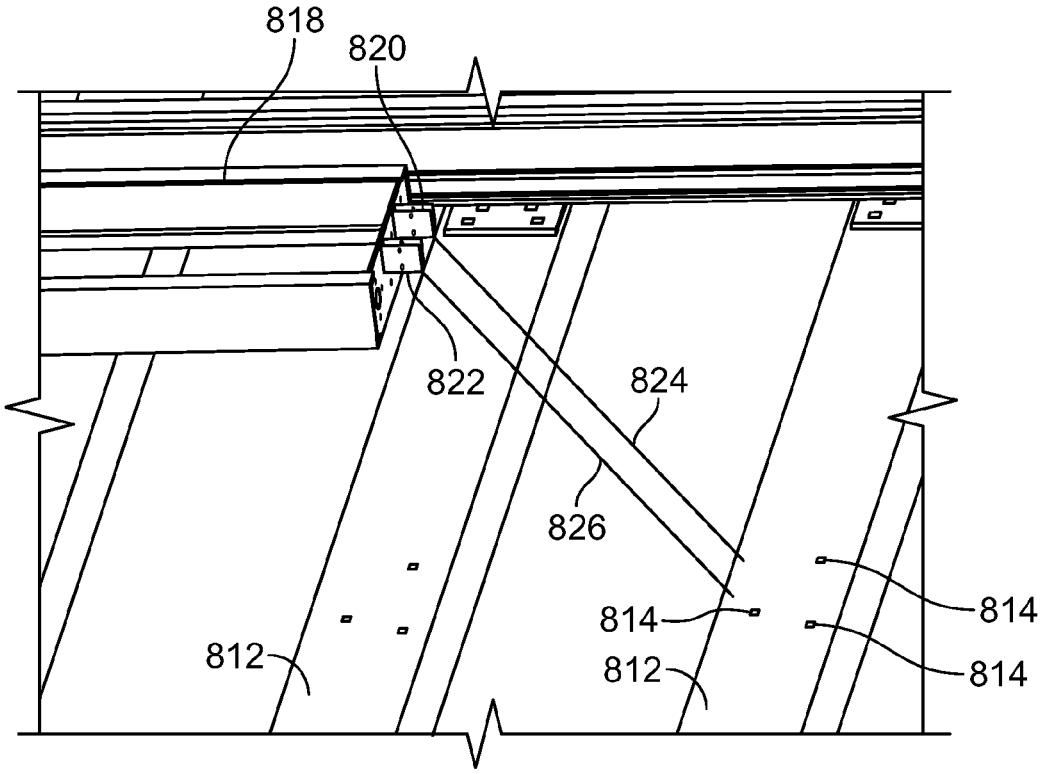
FIG. 9 is an orthogonal view of the spike hole detection system of FIG. 8, where the laser beam has advanced onto a railroad cross-tie.
Figure 10:
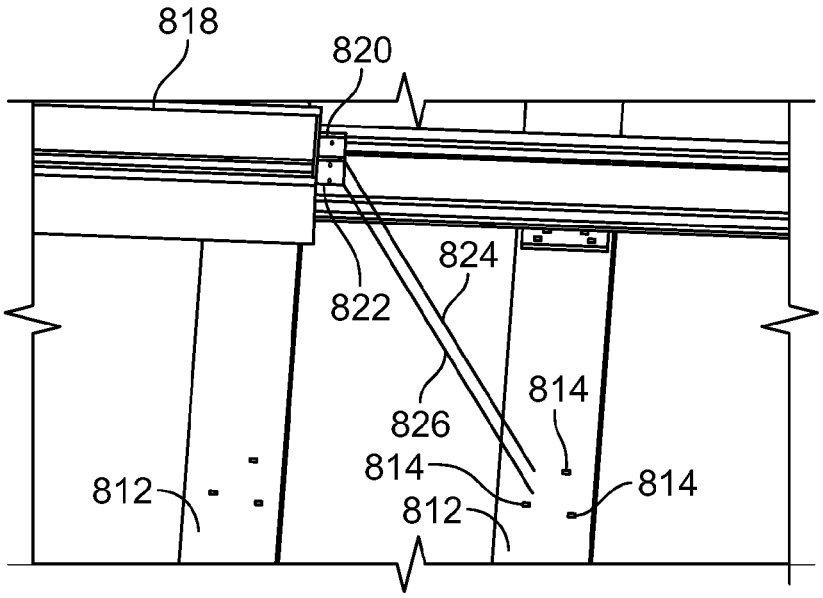
FIG. 10 is an orthogonal view of the spike hole detection system of FIG. 8, where the laser beam has advanced toward the center of the cross-tie.

FIGS. 8-11 show an example of the operation of the spike hole detection system as it moves from left to right along a railroad track. In FIG. 8, laser beams 824 and 826 are positioned over the ballast between cross-ties 812, and the microprocessor reports a value of "false" for both laser distance measuring units 820 and 822. In FIG. 9, laser beams 824 and 826 have just moved onto the top of cross-tie 812 and have initially entered a predetermined distance range (sensor range). However, the microprocessor is programmed with a delay and continues to report a value of "false" for laser distance measuring units 820 and 822. In FIG. 10, laser beams 824 and 826 have continued to travel over the top of cross-tie 812, the delay period has expired, and the microprocessor now reports a value of "true" for laser distance measuring units 820 and 822.

Figure 11:
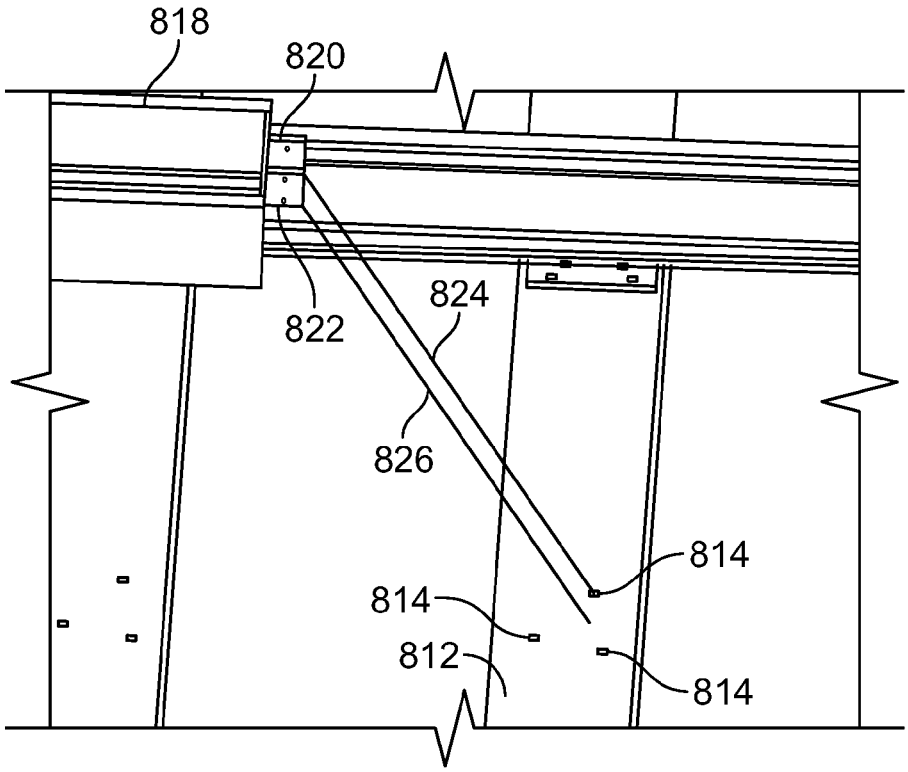
FIG. 11 is an orthogonal view of the spike hole detection system of FIG. 8, where the laser beam has advanced over a spike hole in the cross-tie.

The detection system locates a spike hole when the microprocessor reports different values for the laser distance measuring sensors—e.g., when one laser distance measuring sensor is "false" and the other laser distance measuring sensor is "true". As shown in FIG. 11, laser beam 824 has moved over a spike hole 814 in cross-tie 812, while laser beam 826 remains positioned on the top of cross-tie 812. Because laser beam 824 is positioned over spike hole 814 the distance measured is now greater than and falls outside the sensor range, and the microprocessor reports a value of "false" for laser distance measuring sensor 820. Laser beam 826 remains positioned on the top of cross-tie 812 and the microprocessor continues to report a value of "true" for laser distance measuring sensor 822. Thus, laser distance measuring sensor 820 and laser beam 824 have detected a candidate spike hole, and laser distance measuring sensor 822 and laser beam 826 confirm that it is located on a cross-tie. The detection system determines the position of the spike hole 814 based on the angle of the laser beam 824 and measured distance with respect to the reference frame, and then records the location of the spike hole and/or reports the location for subsequent action (e.g., automated plugging of the spike hole).

In a preferred embodiment, laser distance measuring sensors 820 and 822 are configured such that laser beams 824 and 826 are at an angle to the top surface of cross-tie 812. This configuration reduces the likelihood that a deep crack in cross-tie 812 will register as a spike hole. Because laser beams 824 and 826 are at an angle, a candidate spike hole must have width as well as depth to allow the laser beam to fall outside of the sensor range. Cracks in the cross-ties will not have sufficient width to register as spike holes. In a particularly preferred embodiment, the laser distance measuring sensors 820 and 822 may be configured such that laser beams 824 and 826 are at an angle of about 15° from vertical, relative to the surface of the cross-ties 812.

Figure 12:
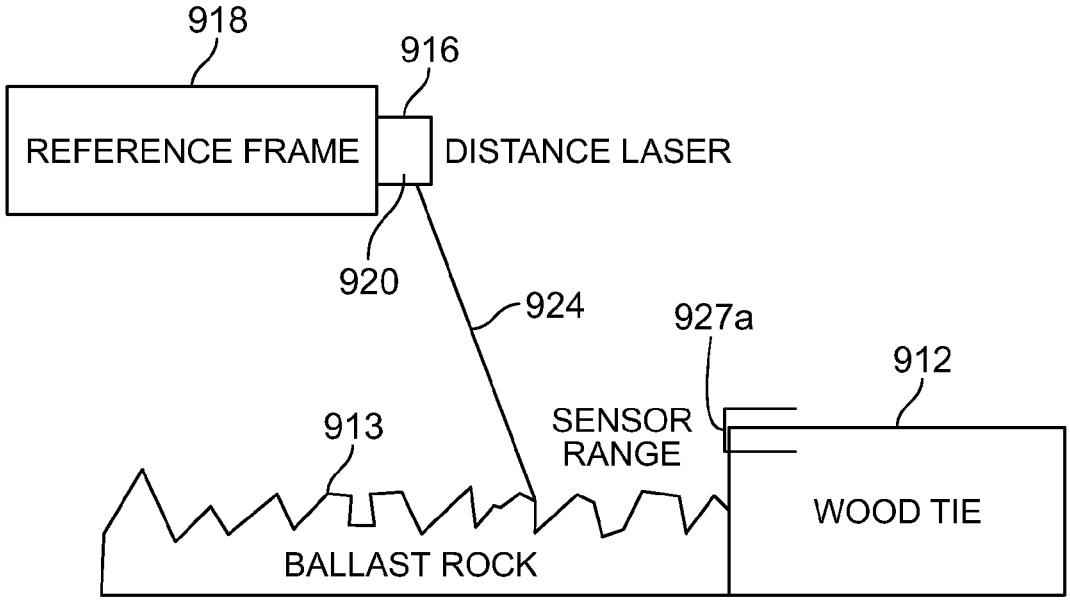
FIG. 12 is a schematic view of a spike hole detection system using laser distance location, that is positioned over a railroad track.
Figure 13:
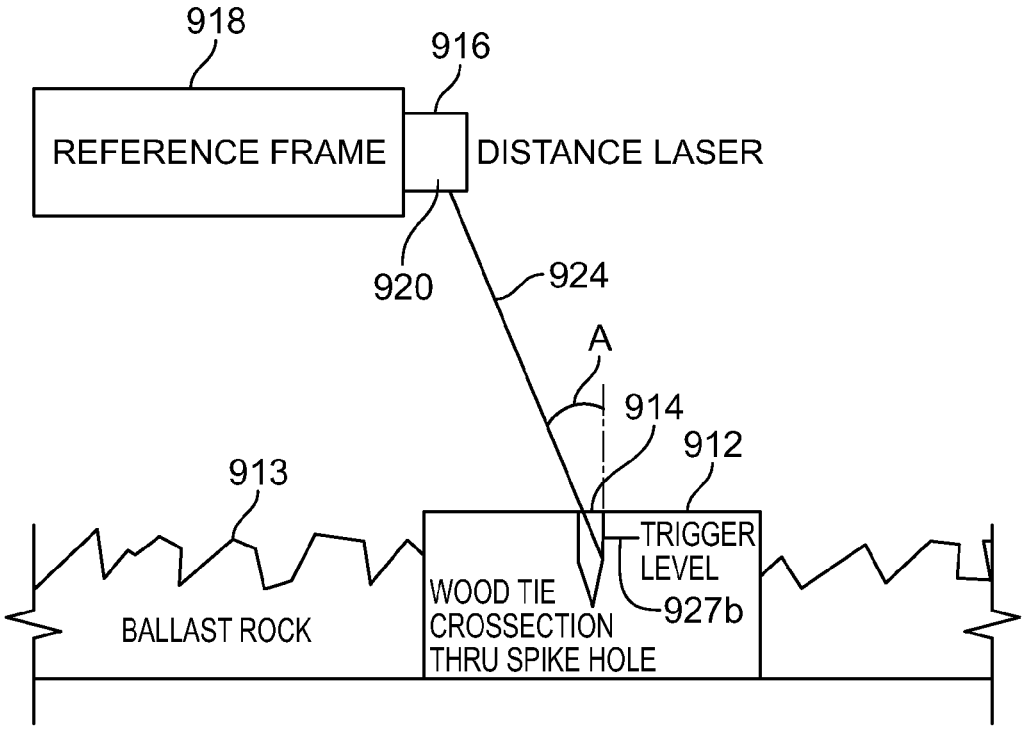
FIG. 13 is a schematic view of the spike hole detection system of FIG. 12, where the laser beam has advanced over a spike hole in a railroad cross-tie.

As shown schematically in FIGS. 12 and 13, a spike hole detection system comprising a reference frame 918 and work head 916, is positioned over a railroad track including a cross-tie 912 embedded in ballast 913. As shown in FIG. 12, work head 916 includes a laser distance measuring sensor 920 with a laser beam 924 positioned over the ballast 913. The spike hole detection system has a predetermined or manually input sensor range 927*a* corresponding to the height of the cross-tie 912.

As shown in FIG. 13, laser beam 924 is positioned over a spike hole 914 in cross-tie 912, and the distance measured is greater than the sensor range 927*a*, as shown by the trigger level 927*b*. The laser distance measuring sensor 920 is configured such that laser beam 924 is at an angle "A" from vertical, relative to the surface of cross-tie 912. It is apparent from FIG. 13, that spike hole 914 must have sufficient width to allow the angled laser beam 924 to penetrate into the spike hole and measure a distance greater than the trigger level 927*b*. If spike hole 914 had a narrower width, such as a deep crack, laser beam 924 could not penetrate past the trigger level 927*b*, and laser distance measuring sensor 920 would continue to report a value of "true" and would not locate a spike hole.

Those of skill in the art will appreciate that the spacing between distance measurement sensors is not critical, provided that the two sensors are not positioned such that they may simultaneously fall within a spike hole(s). In a preferred embodiment, one sensor may be positioned over the center of the cross-tie and the other sensor positioned to travel over the spike holes that are a fixed distance from the rail based on the configuration of the tie plate.

In one embodiment, the spike hole detection system may be configured to scan along the length of a cross-tie to locate an initial spike hole. However, those of skill in the art will appreciate that the spike holes in a cross-tie are positioned at a fixed distance from the rail, based on the configuration of the tie plate. Thus, in an alternative embodiment, an operator may adjust one or more laser distance measuring sensors such that the laser beams are positioned over one or more initial spike holes. The laser beams will then be aligned with the remaining spike holes along the railroad track.

In another embodiment, the spike hole detection system may be mounted on equipment for traveling on the railroad track. For example, the spike hole detection system may be mounted on railroad equipment with a moveable crawler system, such as described in U.S. patent application Ser. No. 11/999,699 to Delmonico, which is hereby incorporated by reference in its entirety. The spike hole detection system determines the position of the spike hole based on the angle of the laser and measured distance with respect to the reference frame, as well as the speed of the railroad equipment measured by the wheel encoder on the equipment axle.

In yet another embodiment, the spike hole detection system may be coupled to other systems, such as spike hole plugging systems that dispense chemicals into spike holes as described above. The spike hole detection system may report the location of the spike holes to the spike hole plugging system to enable fully automated detection and plugging of spike holes. This will allow an operator to provide the initial settings for the systems and then simply monitor the continued operation of the equipment. In a preferred embodiment of a fully automated system, the spike hole detection system operates in advance of the tie plugging system—e.g. detects and records the location of spike holes 4 or 5 cross-ties in advance of the tie plugging system.

The spike hole detection system may also be modified and adapted to detect other features of the railroad track, for use in other applications. For example, the spike hole detection system may be used to detect and locate tie plate holes for spikers, cross-tie edge location for tie extractors, or spike location for spike pullers. In the case of tie plate hole location, the sensor range would need to be adjusted, but the system would work in much the same way as the spike hole example described above. For cross-tie edge location, the system could also work similarly to the spike hole except the laser distance measuring sensors would instead operate to locate the trailing edge of the cross-tie when the laser beams move off the cross-tie. For spike location, the system would work in the opposite method of a spike hole detection system—i.e., by setting the sensor range at the height of the tie plate and locating the raised head of a spike when the distance measured is less than the sensor range. These examples are only intended to highlight the versatility of the spike hole detection system, and other applications for the use of a laser location system in the railroad industry will be apparent to those of skill in the art.

While various embodiments have been described, it will be apparent to those of ordinary skill in the art that many more embodiments and implementations are possible within the scope of the invention. Accordingly, the invention is not to be restricted except in light of the attached claims and their equivalents.

What is claimed is:

1. An applicator for dispensing a material in the spike holes of a cross-tie in a railroad track, the applicator comprising:

a frame;

a first linear actuator mounted on the frame;

an applicator nozzle for dispensing the material, the applicator nozzle coupled to the first linear actuator to move the applicator nozzle relative to the frame;

a microprocessor for controlling the linear actuator;

a memory coupled to the microprocessor; and a predetermined pattern of spike holes stored in the memory, wherein the microprocessor directs the first linear actuator to move the applicator nozzle relative to the frame according to the predetermined pattern of spike holes;

first and second distance measurement sensors configured to measure a distance to the railroad track, the first and second distance measurement sensors coupled to the microprocessor; and a predetermined distance stored in the memory;

wherein the microprocessor reports a first value for the first or second distance measurement sensor when the measured distance is within a first range defined relative to the predetermined distance, and reports a second value for the first or second distance measurement sensor when the measured distance is within a second range; and wherein a first spike hole in the predetermined pattern of spike holes is detected where the microprocessor reports different values for the first and second distance measurement sensors.

2. The applicator of claim 1, wherein the predetermined pattern of spike holes is stored in the memory as a plurality of x,y coordinates.

3. The applicator of claim 1, further comprising a plurality of different predetermined patterns of spike holes stored in the memory, and wherein the microprocessor directs the first linear actuator to move the applicator nozzle relative to the frame according to a predetermined pattern of spike holes selected from the plurality of different predetermined patterns of spike holes.

4. The applicator of claim 1, further comprising:

an applicator head coupled to the first linear actuator to move the applicator head relative to the frame; and a drive mounted on the applicator head;

wherein the applicator nozzle is coupled to the drive to move the applicator nozzle relative to the applicator head in a direction perpendicular to the movement of the first linear actuator.

5. The applicator of claim 4, wherein the railroad track includes at least one rail and the first linear actuator moves the applicator nozzle parallel to the rail.

6. The applicator of claim 1, further comprising:

an applicator head coupled to the first linear actuator to move the applicator head relative to the frame; and a second linear actuator mounted on the applicator head, the microprocessor controlling the second linear actuator;

wherein the applicator nozzle is coupled to the second linear actuator to move the applicator nozzle relative to the applicator head in a direction parallel to the movement of the first linear actuator.

7. The applicator of claim 6, further comprising:

a drive mounted on the applicator head, the microprocessor controlling the drive;

wherein the applicator nozzle is coupled to the drive to move the applicator nozzle relative to the applicator head in a direction perpendicular to the movement of the first linear actuator.

8. The applicator of claim 7, wherein the railroad track includes at least one rail and the first linear actuator moves the applicator nozzle parallel to the rail.

9. The applicator of claim 7, further comprising a plurality of different predetermined patterns of spike holes stored in the memory, and wherein the microprocessor directs the first and second linear actuators and drive to move the applicator nozzle relative to the frame and applicator head according to a predetermined pattern of spike holes selected from the plurality of different predetermined patterns of spike holes.

10. The applicator of claim 1, wherein the first and second distance measurement sensors are laser distance measurement sensors.

11. The applicator of claim 1, further comprising a pneumatic actuator coupled to the frame, to move the frame vertically relative to the railroad track.

* * * * *